166-66 SR
4/10/84 XR 4,441,561

United States Patent [19]

Garmong

[11] 4,441,561

[45] Apr. 10, 1984

[54] METHOD AND APPARATUS FOR TREATING WELL FORMATIONS

[76] Inventor: Victor H. Garmong, R.D. No. 1, Kennerdell, County of Venango, Pa. 16374

[21] Appl. No.: 322,220

[22] Filed: Nov. 17, 1981

[51] Int. Cl.[3] ..... E21B 33/128; E21B 43/00

[52] U.S. Cl. ..... 166/387; 166/254; 166/188; 166/122; 166/66; 166/77; 138/89; 138/93

[58] Field of Search ..... 166/254, 255, 196, 191, 166/187, 188, 113, 119, 120–122, 64, 66, 77, 79, 387; 277/34.6, 116.4, 27, 113, 120; 294/86.15, 86.17, 86.24; 138/89, 93

[56] References Cited

U.S. PATENT DOCUMENTS

| | | | |
|---|---|---|---|
| 2,715,444 | 8/1955 | Fewel | 166/187 |
| 2,799,351 | 7/1957 | Osmun | 166/192 |
| 3,145,771 | 8/1964 | Pennebaker, Jr. | 166/255 X |
| 3,165,918 | 1/1965 | Loomis | 73/40.5 |
| 3,392,785 | 7/1968 | King | 166/196 |
| 3,587,736 | 6/1971 | Brown | 166/187 |
| 3,918,520 | 11/1975 | Hutchison | 166/64 |
| 3,920,076 | 11/1975 | Laky | 166/77 X |

*Primary Examiner*—Ernest R. Purser
*Assistant Examiner*—Thuy M. Bui
*Attorney, Agent, or Firm*—Carothers & Carothers

[57] ABSTRACT

A method and apparatus for locating, isolating and treating a section of a formation located downhole in a well bore by analyzing the formation for location of the section to be treated and isolating the section to be treated, and subjecting the isolated section with treating fluid with a single-type or straddle-type expandable packer assembly. The treating fluid is fed downhole to the packer assembly through a flexible conduit which is paid-off from a reel located above ground from a mobile unit. The radially expandable packer elements of the straddle packer assembly are independently expanded and contracted with the application of positive expanding and contracting forces applied thereto through remotely located controls above ground. The packer assembly may also include a formation sensing unit for sensing downhole fluid-bearing strata while the packer assembly is being lowered. The formation sensor is monitored at a remote location above ground for properly positioning the packer assembly downhole at desired fluid-bearing strata locations for treatment.

36 Claims, 6 Drawing Figures

10
12
14
25
26
27
28
29
30
31
32
33
34
35
37
38
39
40
41
42
45
46
51

14
20
75
16
13
19
12
22
10
18
15
19
11
75
17
21
50
14
51
33
33
28
13
10
51
12
60
60
68
64
67
62
20
63
71
70
17
11
11
65
51
66
60
60
60
62
16
75
75
63
21
71
51
11
70
60
60
12
51
19
18
19
22
19
15
50
51

METHOD AND APPARATUS FOR TREATING WELL FORMATIONS

BACKGROUND OF THE INVENTION

The present invention relates to methods and apparatus for treating downhole formations in oil and gas wells and the like, such as for the hydrofracturing of a well formation through the use of expandable packer assemblies positioned downhole in the well bore.

While a large number of oil and gas wells are drilled to a depth and completed below 2,000 feet, nevertheless, a very significant number of wells are still being drilled and completed today at levels above 2,000 feet. Many of these wells are completed open-hole, without a well casing extending to considerable depths within the well bore, for reasons of enhanced primary oil or gas recovery and cost efficiency. The technique of hydrofracturing is currently used to make commercial wells out of marginal wells, yet the technological advances in hydrofracturing techniques have not significantly advanced or developed since prior to 1940. The present day known methods of hydrofracturing a section of a well bore formation downhole require the use of cable tool and completion rigs, which basically consist of a mast which must be erected at well site and held in position by stays, and a cable block and tackle assembly for lowering the packer assembly downhole on the end of a string of rigid pipes, with intermediate stops to connect additional pipe sections.

Presently, two basic methods of hydrofracturing are being utilized, both of which require the use of cable tool and completion rigs, in order to prepare a downhole zone within a well bore for hydrofracturing. The first method is to fill the well hole to a point just below the zone to be fractured with a fill, such as pea gravel. A single element steel and rubber packer assembly is then lowered into the hole on a string of rigid pipes, to a point just above the zone. The packer element on the packer assembly is then set or radially expanded to seal off the zone from the surface, and hydrofracturing equipment is then connected to the pipe string at the surface and the zone is hydrofractured by pumping a hydrofracturing fluid under pressure into the zone.

In order to hydrofracture lower additional zones in the well, the packer element is collapsed and a small diameter pipe string is lowered through the larger hydrofracturing supply pipe until the smaller coaxial inner pipe engages the fill. The fill is then washed from the annulus of the pipe to a point below the next zone within the well to be treated, and the packer assembly is then lowered and the process is repeated.

A second method commonly used in hydrofracturing a well involves the use of a two-element packer assembly, or a packer assembly having an upper and a lower expandable packing element (commonly referred to as a straddle or straddler packer), wherein the zone or section of the well formation to be treated is straddled or sealed off, and a ball dart is dropped in the packer assembly to plug the bottom of the packer. The packer assembly is positioned downhole and the packer elements are simultaneously set or expanded, sealing the annulus above and below the zone. The hydrofracturing equipment is connected to the upper end of the rigid pipe string above ground and the zone is fractured with fluid under pressure. Additional zones within the well are fractured by collapsing the packer assembly packing elements and moving the assembly to straddle the next zone and repeating the process.

Both of the above described methods require a considerable amount of time in operation, for example, approximately three hours or more in treating a 1,000 ft. well, and this assumes that no other problems are encountered, such as the packing elements of the well packer assembly becoming stuck in formation notches downhole.

This explanation of prior art techniques of hydrofracturing has been somewhat simplified, in that most well formations in the eastern United States consist of naturally cemented sand grains, and thus are extremely hard. Both the single element and straddle packers have pressure limitations necessitating the use, prior to fracturing, of notching the well formation, whereby the zones to be fractured are first subjected to a high pressure sand-laden stream of air or water thereby cutting a notch into the formation of the zone. The notch thus effects a plane of weakness aiding in the initial breakdown of the formation when subjected to fracture pressures. Use of such formation notches necessitates accurate measurement and placement of the straddle packer, because a packer element which is set or expanded in such a notch and subsequently pressured with hydrofracturing fluid, will often become permanently stuck in the well hole.

The prior art methods and apparatus utilized for fracturing a well formation are highly susceptible to the encountering of a number of problems when used for open hole completion. For example, the time required to erect or assemble and subsequently disassemble the cable tool and completion rig is considerable. The time element required for connecting and running pipe sections is also considerable. Leaks at the pipe joints are also possible due to frequent useage and connecting and disconnecting. It is extremely difficult to accurately determine the packer location in the well hole or to set the packer assembly opposite the producing formation to be treated.

Many of the prior art packer assemblies also require the use of metal slips and/or metal springs which commonly break, and the rubber or elastic sealing elements have been known to come off the packer assembly under pressure. On occasion, sand may also find its way under the resilient packer elements or sleeve, thereby preventing the packer from collapsing. In addition, it is not always possible to determine when the packer is, in fact, set or collapsed in the well hole.

Considerable time is also required to release and reset a packer assembly of the prior art, change the downhole position thereof, and disconnect and reconnect the hydrofracturing equipment from and to the pipe string each time a different zone within the well bore is to be treated. In addition, with some prior art packer assemblies, the outside diameter thereof is so close to the diameter of the well bore that difficulties are encountered in getting the packer down the well hole. Also, those packer assemblies which require the use of a ball dart as previously explained, sometime encounter the problem that the ball dart does not properly set in the bottom of the packer. The prior art packers which utilize metal slips also sometime encounter the problem that the metal slips won't hold in the formation to set the packer. The metal slips are generally first set to temporarily hold the packer and then the packer elements are thereafter expanded. The metal slips may initially not hold, or they may slip when the packer elements are expanded, causing the packer assembly to be improperly positioned.

It is a principal object of the present invention to provide a method and apparatus for treating well formations which are devoid of the aforedescribed disadvantages of the prior art.

SUMMARY OF THE INVENTION

The method and apparatus of the present invention for treating a well utilizes a unique packer which is expanded and contracted downhole from a remote or above ground location. A flexible high pressure fracturing fluid supply hose is connected to the packer assembly and lowered downhole with it instead of utilizing a string of rigid pipe sections, as is done in the prior art. The packer assembly is thus lowered down the well hole with the flexible high pressure hose, together with any other required flexible connections to the packer assembly for support or actuation, preferably from a reel pay-off system mounted on a mobile unit such as a rubber-tired vehicle or truck. In yet a further embodiment of the present invention, well formation sensing or analyzing equipment may be secured to the packer assembly and monitored from the surface at a remote location to sense and analyze the well formations as the packer assembly is being lowered down the well hole to locate fluid-bearing strata and properly position the packer assembly for treatment thereof.

In the packer assembly of the present invention, at least one resilient and radially expandable packer element is utilized. In most situations, an upper and lower packer element will be utilized in the packer assembly to provide a straddle-type packer.

The packer element of the present invention is unique in that a force is not only supplied to the packer element to cause it to expand radially outwardly for engagement with a well bore, but in addition, a force is also applied to the packer element to positively force it to retract or contract radially inwardly out of engagement with the well bore. When stating that a force is applied to the packer sleeve to also positively force it to radially contract, it is intended that this force is independent of any force which might be naturally or inherently applied to the packer element due to its natural resiliency. With this positive contracting capability, it is insured that the packer element will, in fact, collapse when required, and it will not become stuck in the well hole or in the well hole formation.

The packing element or elements are also remotely controlled from a location above ground, as by a hydraulic control unit which is connected to the packer assembly through the use of downhole flexible conduit, or by remote wireless control. When two packer elements are utilized in a straddle packer assembly arrangement, the packer assembly of the present invention is also unique in that each of the packer elements may be independently controlled, or expanded and contracted, from an above ground location. This permits more versatile operation and use of the packer assembly. In addition, the requirement of conventional metal slips and springs as used in prior art packer assemblies is eliminated. However, metal slip elements having serrations thereon for gripping the well bore walls may be provided on the resilient packer elements themselves to prevent the resilient packer elements from flowing vertically against the well bore walls when extreme radial expansion pressures are applied to the packing elements.

The packing elements themselves on the packer assembly preferably consist of sleeves of resilient material, such as synthetic rubber of very durable capabilities, which is coaxially received over the body of the packer assembly. In order to radially expand the sleeves, they are axially compressed, as by a hydraulic piston cylinder arrangement, and in order to contract the sleeves, they are axially stretched with the application of a positive force, such as through the use of a hydraulic piston cylinder arrangement.

When a strata or formation sensing unit is also secured to the packer assembly, for sensing fluid-bearing strata in the well bore as the packer assembly is being lowered therein, a conventional optical or electrical sensing unit may be utilized, and preferably a gamma ray sensing unit. The sensing unit is connected to an above ground mobile monitoring station through the use of flexible conductors or a wireless transmission system. The monitoring station may include cathode ray tube displays, recorders, and other analyzing equipment such as a computer, for displaying and analyzing the strata formation signals transmitted from the downhole sensing unit.

To further summarize, by utilizing a reel feed pay-off system for lowering the packer assembly and high pressure fracturing fluid hose at a rapid rate, and thus further requiring only a one-time connection of a supply of high pressure fracturing fluid to the flexible hose, the time element involved for well treatment is drastically reduced over that of the prior art. No pipe connections are required to be made during the step of lowering the packer assembly into the well or during the step of raising the packer assembly from the well. The present invention eliminates the prior art requirement of storing and moving a large number of rigid pipe sections and the requirement of connecting and disconnecting hydrofracturing equipment to the pipe sections when lowering or raising the packer assembly respectively in the well bore to fracture different zones therein, and further eliminates the possibility or risks of pressure leaks at pipe joints and completely eliminates the requirement of erecting and disassembling a cable tool and completion rig at the well site. Additionally, no mechanical metal slips or springs are required in the packer assembly, which are susceptible to mechanical breakage problems. Moreover, some prior art mechanical slips are utilized to effect compression of the rubber sealing or packing elements for the high pressure hydrofracturing treatment, and since such mechanical slip elements are eliminated in the packing assembly of the present invention, the packer or packing assembly of the present invention does not require dependence upon the type of structure of the producing well formation to compress the rubber sealing or packing element through mechanical slips.

Also, the design of the elastomer sealing or packing elements in the packer assembly of the present invention drastically reduces the risks of sand building up under the element and of the element coming off of the packer assembly body under pressure because of the fact that the ends of each packing sleeve are directly bonded to metal rings utilized to mount the packer sleeves to the packer assembly body for axially compressing or extending the resilient sleeves.

Furthermore, not only can the pressure of the fracturing fluid being pumped to the packer assembly be continually monitored above ground, but also, the hydraulic pressures supplied to actuate and de-actuate the resilient packing element may also be monitored from a remote above ground location to quickly and accurately determine the status of actuation of the packer assembly. The use of strata sensing apparatus, such as a gamma ray sensor, mounted directly on the packer assembly, is also useful and accurate in locating and defining the producing formations which the well bore for treatment and for accordingly also accurately positioning the packer assembly, the gamma ray sensing outputs being continually monitored at the surface for analysis. Use of such a formation sensing device as a gamma ray sensor, allows for exact location of the zone to be notched and fractured in the well bore. In the conventional prior art methods, location of the zone to be treated is done by physical measuring of the joints of the rigid pipe sections of predetermined length which are used to convey the high pressure fracturing fluid to the packer assembly, and this measuring technique is correlated with a well structure or formation log that is previously run with gamma ray equipment or the like prior to utilization of the packer assembly equipment. Accordingly, considerable inaccuracies are encountered in attempting to position the packer assemblies of the prior art in the proper zone for fracturing based on previous measurements of the location of the zone. Proper and exact location of the zone to be fractured is extremely critical and can mean the difference between a dry well and a good commercially producing well. Well packer failure and treating results can also be continually monitored from the surface through the use of monitoring the pressures applied to each of the packer elements and the fracturing fluid, and the monitoring of the status of the well formation prior to and subsequent to fracturing, without necessitating the removal of the packer assembly from the well bore.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figures 1, 3A:
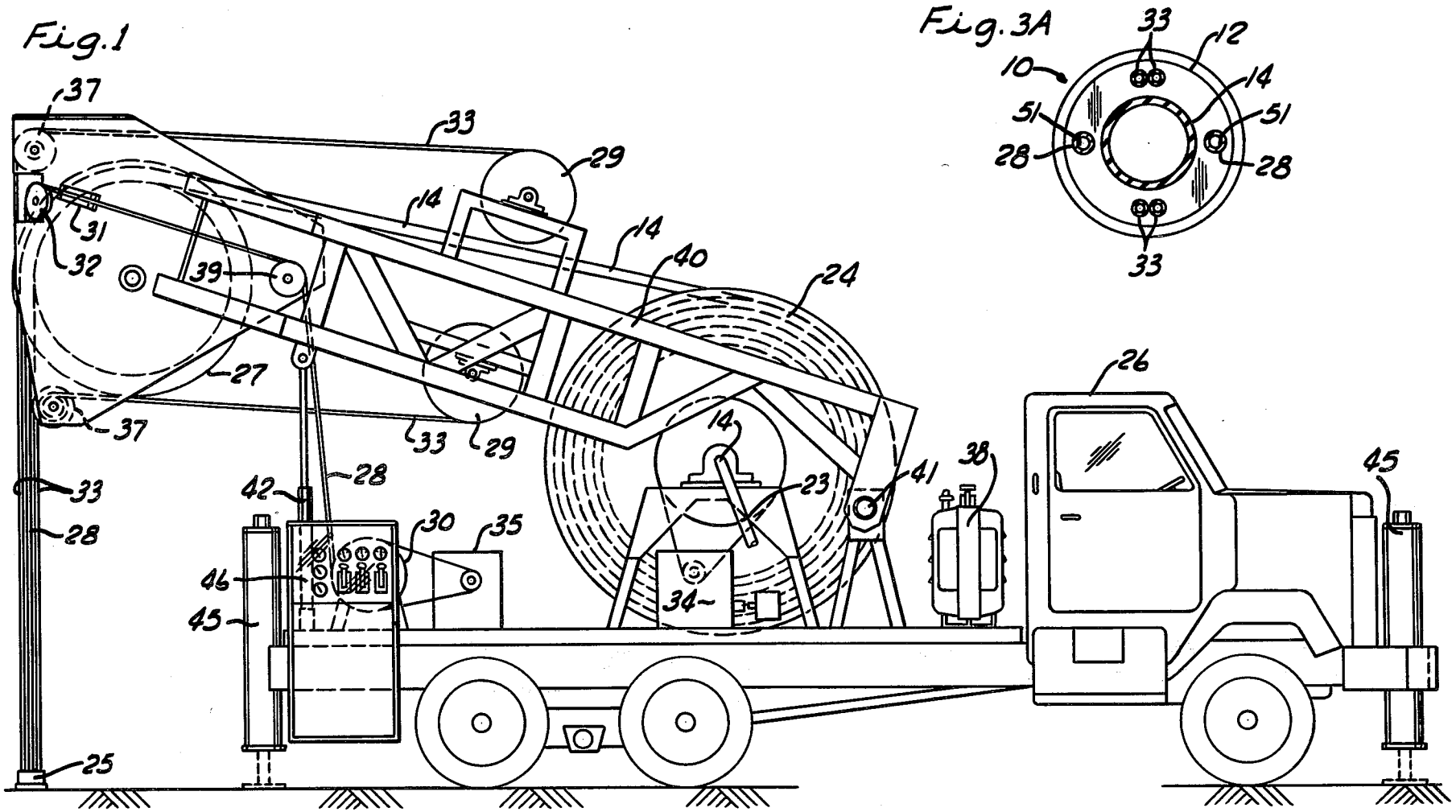
FIG. 1 is a simplified or diagrammatic view in side elevation of a vehicle supporting the reel pay-off system for the flexible high pressure treatment hose and other flexible connecting hoses and lines utilized with the well treating method and apparatus of the present invention.
FIG. 3A is a plan or top view of the well packer assembly shown in FIG. 3.
Figures 2, 4:
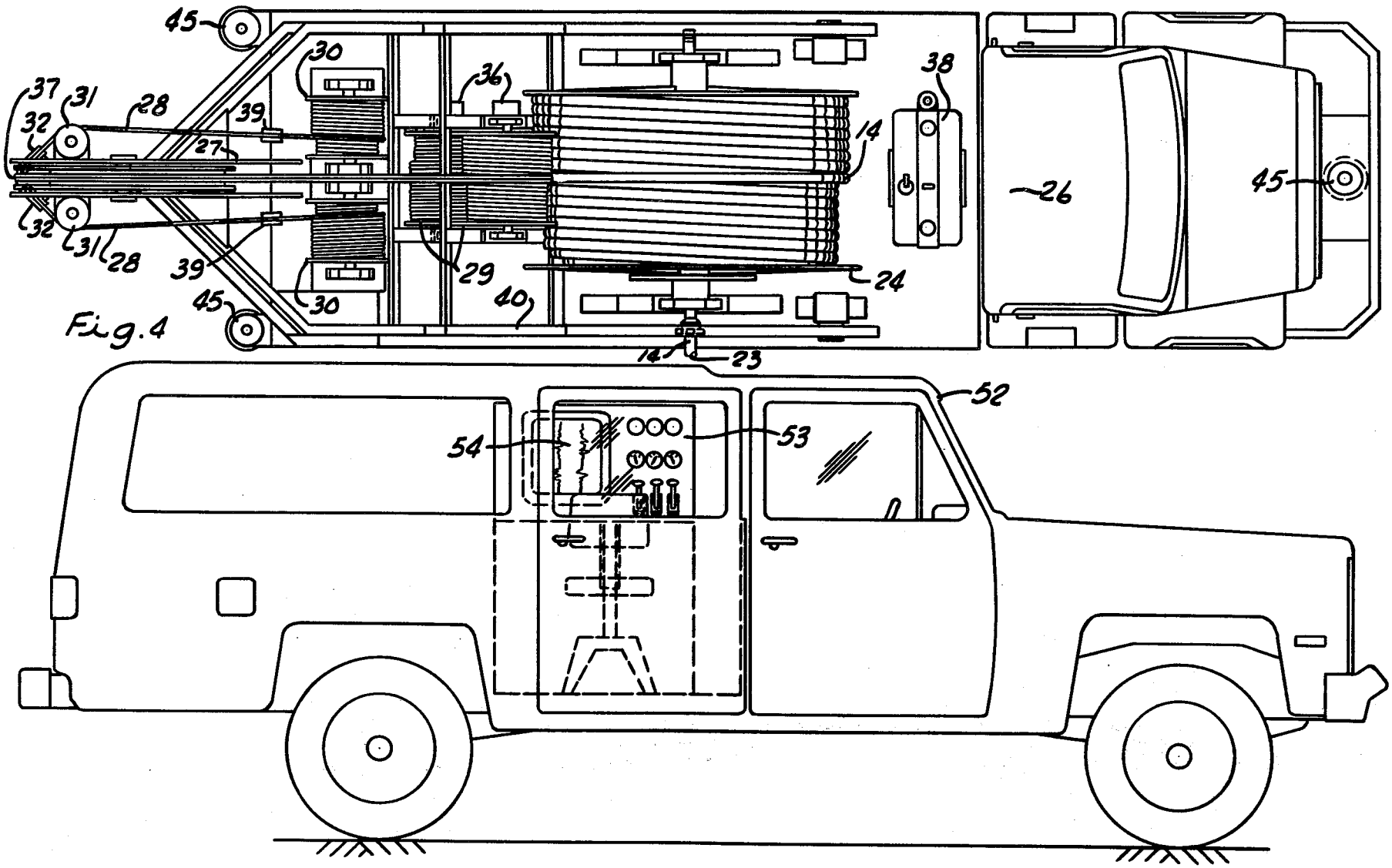
FIG. 2 is a plan view of the mobile unit illustrated in FIG. 1.
FIG. 4 is a simplified or diagrammatic view in side elevation of a remote mobile control and monitoring unit for the apparatus illustrated in FIGS. 1, 2 and 3.
Figures 3, 5:
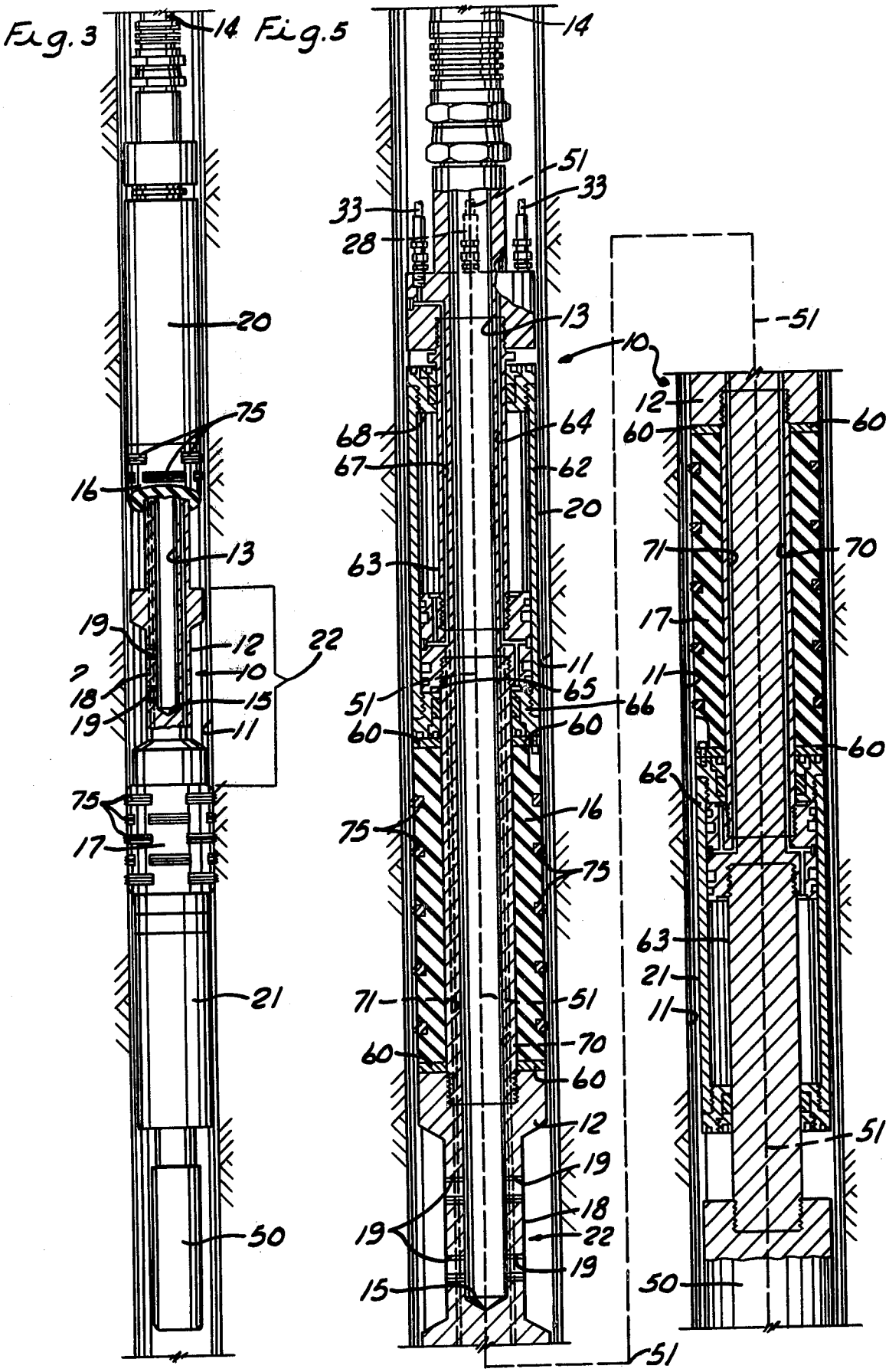
FIG. 3 is a view in side elevation illustrating the straddle-type well packer assembly of the present invention positioned in a well shown in vertical section and as utilized in combination with the mobile equipment illustrated in FIGS. 1 and 2 of the present invention.
FIG. 5 is an enlarged view in vertical cross section of the straddle packer assembly shown in FIG. 3 illustrating the operational details thereof.

Referring first to FIGS. 1, 2, 3 and 3A, the well packer assembly 10 of the present invention is illustrated in FIGS. 3 and 3A, and in FIG. 3 as being lowered within well bore 11. Well packer assembly 10 is generally comprised of an elongated body member 12 having a generally longitudinally extending bore 13 therein for communicating with high pressure fluid treatment hose or conduit 14 at its upper end and closed at its lower end 15, together with vertically spaced upper and lower resilient and radially expansible packing elements 16 and 17 respectively. Upper and lower packing elements 16 and 17 are exteriorly mounted on body member 12 with an intermediate portion 18 of body member 12 exposed therebetween. Port means in the form of ports 19 are provided in intermediate portion 18 and communicate the exterior of intermediate portion 18 with longitudinally extending bore 13.

Upper and lower packing elements 16 and 17 consist of resilient sleeves made of a durable synthetic rubber, such as the type of rubber which is generally used in shock absorber systems for large off road land vehicles. Upper packing element or sleeve 16 is radially outwardly expanded and radially inwardly contracted by upper hydraulic power unit 20, and lower packing element 17 is radially outwardly expanded and radially inwardly contracted by means of lower hydraulic power unit 21.

Upper packing sleeve 16 is illustrated in its contracted position and lower packing sleeve 17 is illustrated in its radially expanded position whereby it is engaging the inner walls of well bore 11 to seal the same off. Upper and lower hydraulic power units 20 and 21 expand and contract their respective packing seals or elements 16 and 17 by axially compressing the resilient sleeves to expand the same, and by axially drawing the resilient sleeves 16 and 17 under tension to contract them and insure that they positively disengage the well bore 11, even though there might be deformities in the well bore in which the resilient packer sleeves might otherwise become stuck.

The upper and lower packing sleeves 16 and 17 are thus expandable radially outward for sealing engagement with well bore 11 to seal off section 22 thereof intermediate the packing sleeves for subsequent supply of fluid under pressure to this sealed off section through ports 19 for fracturing.

Referring additionally to FIGS. 1 and 2, flexible fluid conduit 14 is connected at its lower end (FIGS. 3 and 3A) to communicate with the upper end of longitudinally extending bore 13, and the other end of flexible high pressure conduit 14 is connectable at 23 (FIGS. 1 and 2) to a fluid source under pressure (not shown). High pressure flexible fluid conduit 14 is coiled on reel 24 for pay-off into the well bore 11 through well casing 25. Reel 24 is in turn mounted on the bed of truck 26 for mobility.

Flexible conduit 14 is paid-off of reel 24 into well bore 11 by passing over pulley 27 to lower packer assembly 10 down the well bore. Packer assembly 10 is additionally supported by two flexible wire cables 28 which are coiled onto reels 30 for pay-off down the bore hole via guide pulleys 39, 31 and 32. Reels 30 are also mounted on the bed of truck 26.

Upper and lower hydraulic power units 20 and 21 are hydraulically operated through twin hydraulic hoses 33, which are also flexible and fed downhole, together with treatment hose 14 and cables 28, from reels 29, which are also mounted on the bed of truck 26.

Pay-off reel 24 is driven to reel up and reel out by drive motor 34, cable reels 30 are driven by drive motor 35, and reels 29 for feeding out or reeling up twin hydraulic hoses 33 are driven respectively by gear motors 36. Twin hydraulic hoses 33 are fed downhole via guide pulleys 37.

The power to drive all of these motors and the hydraulic equipment required is provided by a conventional gasoline driven power unit 38 on the bed of truck 26 to provide electrical and/or hydraulic pressures as required.

Flexible cable 28, flexible high pressure treatment hose 14, and twin hydraulic hoses 33 are all paid-off of their respective reels and guided together for combined feeding up or down well bore 11 through well casing 25 by means of respective guide pulleys carried on broom or mast 40. Mast 40 is raised or lowered about its pivot 41 by means of mast raising hydraulic cylinder 42.

When the packer assembly 10 has been fully raised out of bore hole 11, it can be readily positioned on the bed of truck 26 and mast 40 is lowered by cylinder 42 and truck 26 is then ready to move to the next well hole for treatment. When truck 26 reaches the next well hole, it backs up to the well, mast 40 is raised to the desired position, levelling jacks 45 are set to stabilize the truck 26, and the packer assembly 10 is inserted down the well casing.

Control station 46 is also provided on the bed of truck 26, and includes logic controls for regulating the pay-off of flexible cables 28, twin hydraulic hoses 33, and flexible high pressure treatment hose 14 from their respective reels, valve controls for the supply of hydraulic fluid to twin hydraulic hoses 33, and also monitors the fluid pressures in twin hydraulic hoses 33, and may also monitor the pressure in flexible high pressure treatment hose 14.

When feeding all of the flexible cables and hoses downhole from their respective pay-off reels, or for that matter when reeling them up onto their respective reels, it is important that wire support cables 28 carry most of the load or that none of the hoses are overtensioned, or that the tension in all hoses and lines are equalized. To accomplish this, conventional tension sensors or transducers are provided for each reel which, through the torque applied to that particular reel, sense the tension applied to the hose or line which it is paying-off or reeling up. These tensions from the transducers on each reel are monitored in control station 46 and through conventional logic or computer means, the respective reel motors are controlled to maintain the proper and constant tensions on their respective flexible lines and hoses.

Well packer assembly 10 is further provided with a well bore strata sensing unit 50, connected to the bottom thereof, for sensing fluid-bearing strata in well bore 11 as the packer assembly 10 is being raised or lowered therein. In this instance, the sensing unit 50 is illustrated as being positioned at the bottom of assembly 10. However, it may be positioned elsewhere on the packer assembly 10, such as on the upper end thereof. Sensing unit 50 in this instance is a gamma ray sensing unit which senses the nature of the well bore formation by gamma ray radiation. Other types of sensing may be utilized, such as optical detection, current conduction, or induction methods, or any method which will identify the sand or earth formation to be treated.

Gamma ray sensing unit 50 is connected for above ground monitoring and analyzing via flexible electrical conductors 51 which pass through the hollow interior of flexible support cables 28. These electric conductors or wires 51 are eventually connected to control station 46 on truck 26.

Control station 46 and all of the controls and monitoring equipment thereon is duplicated at a remote location from truck 26 in ruck 52 as seen in FIG. 4. This control station 53 has the same remote controls for the packer assembly and monitoring instruments for the packer assembly as those found in control station 46, and in addition thereto has a gamma ray analyzer for analyzing and displaying the sensing signals from gamma ray sensing unit 50. The gamma ray analyzer results are displayed on a CRT display 54. Of course, they may also be displayed on a conventional recorder. Control station 53 of vehicle 52 is directly connected via flexible conductor means (not shown) to control station 46 on vehicle 26 at the well.

The gamma ray analyzer at control station 53 and the gamma ray sensing unit 50 connected to the bottom of packer assembly 10 is a conventional unit which may be purchased on the market, such as from Schlumberger Well Services or Gearhart Industries.

A more detailed showing of packer assembly 10 is illustrated in FIG. 5. Here, the different connecting metal parts of elongated body member 12 are illustrated as being coaxially threaded together. However, it is evident that the respective parts may also be bolted together, and in fact, bolting is an easier method of axially linking the respective parts of elongted member 12 in order to properly align and seal the numerous hydraulic channels longitudinally passing through member 12.

The upper and lower annular ends of resilient packing sleeves 16 and 17 are securely and directly bonded to annular metal rings 60. Thus, when resilient packing sleeves 16 and 17 are axially compressed or stretched by their respective hydraulic power units 20 and 21, it is insured that no sand or dirt can creep in under the sleeves 16 and 17, nd it is further insured that positive compression and stretching forces can be applied to the respective sleeves 16 and 17, and the sleeves cannot slip over or pull away from the axial drive cylinders 62 of hydraulic power units 20 and 21.

As previously explained, hydraulic power units 20 and 21 are controlled independently of each other from control station 46 or control station 53 through respective independent hydraulic feed lines in packer elongated body member 12, which in turn are fed from twin hydraulic hoses 33.

Hydraulic power units 20 and 21 are double acting hydraulic power units, each consisting of an axially movable outer piston cylinder 62 which is slidably received over an inner cylindrical member 63, with appropriate hydraulic seals to prevent leakage therebetween.

By way of example, upper packing sleeve 16 is expanded by feeding hydraulic fluid under pressure in passage or line 64, which is fed from one side of the right-hand twin hydraulic line 33. This applies hydraulic pressure at 65 against the face of cylinder piston 66, which causes cylinder member 62 to be forced downwardly and accordingly axially compresses resilient sleeve 16 to cause the same to expand radially outwardly to engge and seal off the well bore thereabout.

To contract packing sleeve 16 away from well bore 11, pressure is relieved to tank in passge 64 and hydraulic fluid under pressure is introduced into passage 67, which is fed from one side of the left-hand twin hydraulic line 33. This causes hydraulic fluid under pressure to be exerted against the annular face of cylinder piston 68, which causes cylinder member 62 to be forced upwardly. Since the upper annular end of sleeve 16 is bonded to ring 60, and ring 60 is in turn bolted to the bottom of cylinder member 62, positive stretching forces are applied to resilient sleeve 16, making certain that the same fully contracts, even though it might otherwise have been stuck or jammed in crevices within the formations of well bore 11.

Lower hydraulic power unit 21 is operated in a similar manner through fluid passages 70 and 71, which are respectively fed from the other side of the two twin hydraulic hoses 33. The hydraulic pressures in all of the feed lines within win hydraulic hoses 33 are continually monitored at the surface at control stations 46 and 53, which will give a positive indication of whether or not the respective packing sleeves 16 and 17, one independent of the other, are fully expanded or contracted. Conventional control equipment is also provided at the monitoring and control stations to automatically maintain the proper pressure in each control unit 20 and 21 when the sleeves are expanded or set to seal off the well bore, thereby insuring that the packer elements do not slip. Emergency pressure relief valves are also provided in the control stations to shut down the equipment should the hydraulic fluid pressures become excessive.

Rigid metal grippers in the form of annular segments 75 are provided on the exterior of packing sleeves 16 and 17, and are provided with serrations on the outer surfaces thereof to engage and grip the well bore 11 when the packer sleeves have been expanded. These grips 75 prevent the resilient material of packer sleeves 16 and 17 from flowing vertically against the walls of the well bore 11 whe extreme pressures of expansion are exerted on the sleeves. In addition, sleeves 16 and 17 are also preferably molded of a resilient material such that the composition of the material varies from the outside diameter to the inside diameter of the sleeve, so that the sleeves will take a controlled expansion shape on setting against the well bore. The resilient material is harder on the outside diameter portions than on the inside diameter portions to provide this effect.

The present invention is illustrated with all of the flexible hoses, 14 and 33, and the flexible cables or lines 28 being separate from each other and independently fed downhole in the well. However, it is also within the purview of the present invention, that all of the hoses and lines can be unitarily combind into one hoselike structure such that the resultant structure has conduit 14 running down the center and support cables, electrical conductors and hydraulic lines annularly arranged or distributed thereabout and bonded thereto.

A summary of the method of treating a well in accordance with the teachings of the present invention follows. Mobile units 26 and 52 are driven to the well site. Truck 26 is backed up to the well and mast 40 is raised. Packer assembly 10 is removed from the bed of truck 26 and inserted into the well, and truck 26 and mast or boom 40 are maneuvered to properly align the feed hoses and lines over the well.

Truck 52 is positioned slightly remote from the well site and a cable is run from its control station 53 and is plugged into control station 46 of truck 26.

The reels on truck 26 which pay-off the hoses and cables are driven with logic through control station 46 or 53 to maintain equal tension for all lines and hoses and the packer assembly 10 is thus lowered down the well hole.

While the assembly is being lowered, the strata or formation of the well is being monitored from control station 53 by the gamma ray analyzer and CRT display. Through the gamma ray analyzer senser and analyzer, fluid-bearing strata zones to be fractured are detected and the packer assembly 10 is thus accurately positioned through this strata detection. The upper and lower packers 16 and 17 are expanded to seal off the bore and then another vehicle, not shown, from a hydrofracturing company is pulled up alongside vehicle 26 and is a mobile supply of hydrofracturing fluid under pressure. It is connected to flexible conduit 14 at 23 and the hydrofracturing fluid is thus pumped under pressure to the well bore section or zone to be fractured.

Thus, the requirement of using pipe sections has been eliminated. The use of cable tool and completion rigs has been omitted. The requirement for constant recoupling of the hydrofracturing fluid supply truck is eliminated when fracturing different sections or zones within the well, and it is assured that the packer assembly is properly positioned. Moreover, the many other advantages mentioned hereinbefore are also provided.

I claim:

1. A well packer comprising, a resilient and radially expansible packer sleeve mounted on a packer body member, means for applying a force to said packer sleeve to cause it to expand radially outwardly for engagement with a surrounding well bore wall, and means other than the resiliency of said packer sleeve for applying a force to said packer sleeve to positively force it to contract radially inwardly out of engagement with a surrounding well bore wall, said means for expanding and means for contracting said packer sleeve including a supply of fluid under pressure and control means located above ground and flexible conduit means connecting said supply and control means with said packer to independently apply said expanding and contracting forces to said packer sleeve through fluid under controlled pressure from said supply and control means.

2. The well packer of claim 1, including double acting fluid motor means in aid well packer actuated by said supply and control means for axially compressing said packer sleeve to expand it and for axially tensioning it to contract it.

3. The well packer of claim 2, said packer sleeve having substantially rigid annular rings bonded to the opposite annular ends thereof respectively.

4. The well packer of claim 1, including substantially rigid grip elements on the exterior of said packer sleeve to engge and grip a well bore wall when said packer sleeve is expanded to prevent axial flow thereof against a well bore wall.

5. A well packer comprising, a resilient and radially expansible packer sleeve mounted on a packer body member, means for applying a force to said packer sleeve to cause it to expand radially outwardly for engagement with a surrounding well bore wall, and means other than the resiliency of said packer sleeve for applying a force to said packer sleeve to positively force it to contract radially inwardly out of engagement with a surrounding well bore wall, a generally longitudinally extending bore in said packer body member for communicating with a conduit at its upper end and exiting to the exterior of said packer body member below said packing sleeve, and a flexible fluid conduit connected at one end to communicate with the upper end of said longitudinally extending bore and connectable at its other end to fluid under pressure.

6. The well packer of claim 5, wherein said flexible fluid conduit is coiled for pay-off from a reel into a well bore or the like.

7. The well packer of claim 6, wherein said reel is mounted on a land vehicle for mobility.

8. A well tool including, an elongated body member adapted to be lowered into a well bore hole or the like and having a generally longitudinally xtending bore therein for communicating with a conduit at its upper end, a resilient and radially expansible packing element exteriorly mounted on said body member, said longitudinally extending bore exiting to the exterior of said body member below said packing element, means for expanding said packing element radially outwardly for sealing engagement with a well bore or the like to seal off the same for subsequent supply of fluid under pressure to a well bore or the like under said packing element through said longitudinally extending bore, the improvement comprising a felxible fluid conduit connected at one end to communicate with the upper end of said longitudinally extending bore and connectable at its other end to a fluid under pressure, and flexible hose means connectable at one end to a second fluid under pressure and connected at its other end with said expansible packing element for expansion thereof by said second fluid under pressure.

9. The well tool of claim 8 including, a second resilient and radially expansible packing element exteriorly mounted on said body member spaced from and below the first said packing element with said longitudinally extending bore exiting to the exterior of said body member intermediate said packing elements, said flexible hose means connected with said second expansible packing element for expansion thereof.

10. The well tool of claim 9 including, means other than the resiliency of said packing elements for applying a force to said packing elements to positively force them to contract radially inwardly out of engagement with a well bore or the like.

11. The well tool of claim 10 including, remote control means for expanding said packing elements each independently from the other from a remote above ground location.

12. The well tool of claim 9, said packing elements consisting of sleeves of resilient material coaxially received over said body member, said means for expanding said packing elements including means for axially compressing said sleeves to radially expand them.

13. The well tool of claim 12, said packing elements including rigid gripping elements on the outer surface thereof for engaging a well bore or the like when said packing elements are expanded to prevent axial flowing of said packing elements against a well bore or the like when expanded.

14. The well tool of claim 12, including substantially rigid annular rings bonded to the opposite annular ends of said packing sleeves respectively.

15. The well tool of claim 9 including, well bore strata sensing means secured to said body member for sensing fluid-bearing strata in a well bore or the like as said body member is being lowered therein, and remote above ground analyzer means connected to receive data from said sensing means and display said data for analyzing the fluid-bearing strata in a well bore or the like as said body member is being lowered therein.

16. The well tool of claim 9, wherein said flexible fluid conduit and said hose means are coiled on reel means for pay-off into a well bore or the like.

17. The well tool of claim 16, wherein said reel means is mounted on a land vehicle for mobility.

18. A well tool adapted to be connected to a fluid conduit and lowered into a well bore hole or the like for subjecting the same with fluid under pressure supplied through the conduit including, an elongated body member having a generally longitudinally extending bore therein for communicating with a conduit at its upper end and closed at its lower end and adaptable to be axially lowered into a well bore hole or the like, vertically spaced upper and lower resilient and radially expansible packing elements exteriorly mounted on said body member with an intermediate portion of said body member exposed therebetween, port means in said intermediate portion communicating the exterior of said intermediate portion with said longitudinally extending bore, means for expanding said packing elements radially outwardly for sealing engagement with a well bore or the like to seal off a section of the same intermediate said packing elements for subsequent supply of fluid under pressure to the sealed off section through said port means, the improvement comprising, said means for expanding said packing elements including remote control means for expanding said packing elements independently of each other from a remote above ground location.

19. The well tool of claim 18, said remote control means including a supply of fluid under pressure with flexible conduit means connecting said supply independently of the first said fluid conduit with each of said packers through above ground valves for independently applying forces to said packer elements through fluid under controlled pressure.

20. The well tool of claim 18, said packing elements consisting of sleeves of resilient material coaxially received over said body member, said means for expanding said packing elements including means for axially compressing said sleeves to radially expand them.

21. The well tool of claim 20, said packing elements including rigid gripping elements on the outer surface thereof for engaging a well bore or the like when said packing elements are expanded to prevent axial flowing of said packing elements when expanded against a well bore or the like.

22. The well tool of claim 20, including rigid ring members bonded to the opposite annular ends of each of said packer sleeves respectively.

23. The well tool of claim 18, including means other than the resiliency of said packing elements for applying a force to said packing elements to positively force them to contract radially inwardly out of engagement with a well bore or the like.

24. The well tool of claim 18, including a flexible fluid conduit connected at one end to communicate with the upper end of said longitudinally extending bore and connectable at its other end to a fluid under pressure.

25. The well tool of claim 24, wherein said flexible fluid conduit is coiled on a reel for pay-off into a well bore or the like.

26. The well tool of claim 25, wherein said reel is mounted on a land vehicle for mobility.

27. The well tool of claim 18, including, well bore strata sensing means secured to said body member for sensing fluid-bearing strata in a well bore or the like as said body member is being lowered therein, and remote above ground analyzer means connected to receive data from said sensing means and display said data for analyzing the fluid-bearing strata in a well bore or the like as said body member is being lowered therein.

28. A well tool adapted to be connected to a fluid conduit and lowered into a well bore hole or the like for subjecting the same with fluid under pressure supplied through the conduit including, an elongated body member having a generally longitudinally extending bore therein for communicating with the conduit at its upper end and closed at its lower end and adaptable to be axially lowered into a well bore hole or the like, vertically spaced upper and lower resilient and radially expansible packing elements exteriorly mounted on said body member with an intermediate portion of said body member exposed therebetween, port means in said intermediate portion communicating the exterior of said intermediate portion with said longitudinally extending bore, means for expanding said packing elements radially outwardly for sealing engagement with a well bore or the like to seal off a section of the same intermediate said packing elements for subsequent supply of fluid under pressure to the sealed off section through said port means, the improvement comprising, well bore strata sensing means secured to said body member for sensing fluid-bearing strata in a well bore or the like as said body member is being lowered therein, and remote above ground analyzer means connected to receive data from said sensing means and display said data for analyzing the fluid-bearing strata in a well bore or the like as said body member is being lowered therein.

29. A method of treating a well for enhancement of fluid recovery therefrom comprising the steps of, connecting one end of a flexible conduit to the upper end of a well packer assembly having an expansible packer element and a generally longitudinal bore therein which communicates at its upper end with said flexible conduit and with the exterior of said packer assembly below said packer element, connecting one end of flexible hose means with said expansible packer element for expansion thereof with a fluid under pressure to be introduced into said hose means, lowering said packer assembly with said one end of said flexible conduit and said one end of said hose means down a well bore to a predetermined position therein, radially expanding said packer element by introducing fluid under pressure into said hose means from an above ground source to seal off said bore, and introducing a fluid under pressure into said well bore below said packer element from another above ground source of fluid under pressure through said flexible conduit and said longitudinal bore of said packer assembly.

30. The method of treating a well as set forth in claim 29, including the steps of, unreeling said flexible conduit and said hose means from reel means while lowering said packer assembly, and respectively connecting the other end of said flexible conduit and the other end of said flexible hose means to said sources through axial rotary pipe coupling means on said reel means.

31. The method of treating a well as set forth in claim 30, wherein said reel means is mounted on a road vehicle for mobility.

32. THe method of treating a well as set forth in claim 29, including the steps of, providing a second extensible packer element on said packer assembly below the point where said longitudinal bore communicates with the exterior of said packer assembly, and radially expanding said second packer element via said flexible hose means to seal off a section of the well bore intermediate said packer elements prior to the step of introducing the fluid under pressure.

33. The method of treaing a well as set forth in claim 32, wherein said packer elements are radially expanded independently of each other through the use of above ground controls.

34. The method of treating a well as set forth in claim 32, including the step of radially contracting said packer elements by applying positive contracting froces thereto via fluid pressure from said flexible hose means after the step of introducing the fluid under pressure.

35. The method of treating a well as set forth in claim 32, wherein said packer elements are resilient sleeves which are radially expanded by axially compressng them with fluid motor means controlled by said above ground controls.

36. The method of treating a well as set forth in claims 29 or 32, including the step of sensing the nature of the earth strata of the well with sensor means secured to said packer assembly as it is being lowered into the well while monitoring the sensor means with analyzer means from the surface to determine said predetermined position in the well.

* * * * *